US008672027B2

(12) United States Patent
Billman

(10) Patent No.: US 8,672,027 B2
(45) Date of Patent: Mar. 18, 2014

(54) IN SITU FLUID RESERVOIR STIMULATION PROCESS

(71) Applicant: Albert Billman, Southlake, TX (US)

(72) Inventor: Albert Billman, Southlake, TX (US)

(73) Assignee: EOG Resources Inc., Houston, TX (US)

( * ) Notice: Subject to any disclaimer, the term of this patent is extended or adjusted under 35 U.S.C. 154(b) by 0 days.

(21) Appl. No.: 13/660,187

(22) Filed: Oct. 25, 2012

(65) Prior Publication Data

US 2013/0081811 A1 Apr. 4, 2013

Related U.S. Application Data

(63) Continuation of application No. 12/707,892, filed on Feb. 18, 2010, now abandoned.

(60) Provisional application No. 61/154,923, filed on Feb. 24, 2009.

(51) Int. Cl.
*E21B 43/247* (2006.01)
*E21B 43/26* (2006.01)

(52) U.S. Cl.
USPC ..... 166/272.2; 166/259; 166/272.3; 166/308.2; 166/60

(58) Field of Classification Search
USPC ..... 166/256, 259, 272.1, 272.2, 271, 308.2, 166/60, 272.3
See application file for complete search history.

(56) References Cited

U.S. PATENT DOCUMENTS

| | | | | |
|---|---|---|---|---|
| 3,228,468 | A | 1/1966 | Nichols | |
| 3,766,982 | A | 10/1973 | Justheim | |
| 4,083,604 | A | 4/1978 | Bohn et al. | |
| 4,265,310 | A | 5/1981 | Britton et al. | |
| 4,320,801 | A * | 3/1982 | Rowland et al. | 166/248 |
| 5,006,044 | A * | 4/1991 | Walker et al. | 417/12 |
| 5,297,626 | A | 3/1994 | Vinegar et al. | |
| 5,415,231 | A * | 5/1995 | Northrop et al. | 166/303 |
| 5,558,160 | A | 9/1996 | Tudor | |
| 6,953,087 | B2 | 10/2005 | de Rouffignac et al. | |
| 7,416,022 | B2 | 8/2008 | Maguire | |
| 7,445,041 | B2 | 11/2008 | O'Brien | |
| 2005/0252656 | A1 * | 11/2005 | Maguire | 166/256 |

* cited by examiner

*Primary Examiner* — Giovanna Wright
*Assistant Examiner* — Catherine Loikith
(74) *Attorney, Agent, or Firm* — Fulbright & Jaworski LLP

(57) ABSTRACT

A method for stimulating a hydrocarbon-containing formation that includes the steps of: introducing a heat source in the formation; heating a portion of liquid hydrocarbons in the formation to expand hydrocarbon volume, thereby rejuvenating fractures in the formation; passing at least some of the heated liquid hydrocarbons through the rejuvenated fractures; and producing at least a portion of the liquid hydrocarbons that passed through the rejuvenated fractures. The methods and processes provide for in-situ stimulation of hydrocarbon-containing formations using energy to expand in-situ liquid hydrocarbons, thus rejuvenating naturally occurring fractures. In some embodiments, the energy is supplied as heat from injection of an oxygen-containing fluid.

28 Claims, 5 Drawing Sheets

IN SITU FLUID RESERVOIR STIMULATION PROCESS

CROSS-REFERENCE TO RELATED APPLICATIONS

This application is a continuation of U.S. application Ser. No. 12/707,892, filed Feb. 18, 2010, claiming priority to U.S. Provisional Application 61/154,923 filed Feb. 24, 2009.

TECHNICAL FIELD

The present invention relates to reservoir stimulation processes. In one aspect, the invention relates to a stimulation process to recover hydrocarbons from oil shale and similar rock.

BACKGROUND OF THE INVENTION

Many oil shales and other formations contain a great deal of usable hydrocarbons and precursors to usable hydrocarbons, but there are many difficulties in removing the hydrocarbons. Oil shale contains a hydrocarbon precursor known as kerogen, which is a complex organic material that can mature into usable hydrocarbons when exposed to high temperature and/or pressure. Generally, the natural processes that convert kerogen to hydrocarbons occur slowly over many years.

Considering the example of oil shale, it does not have a definite geological definition, and oil shales vary considerably in their content, composition, age, type of kerogen, and other properties. In fact, many will refer to certain formations as oil shale even though the rock may not technically be shale. Regardless, there is a general consensus on various terms used to describe shale characteristics, and people generally characterize oil shale as mature when a large portion of the kerogen has converted to hydrocarbons, and conversely as immature when little of the kerogen has converted to hydrocarbons. One measure of formation maturity is vitrinite reflectance. For example, an immature shale would have mostly kerogen, little or no liquid or gaseous hydrocarbons, and a vitrinite reflectance of less than about 0.5%; a shale of medium maturity would have appreciable amounts of kerogen, liquid hydrocarbons, and gaseous hydrocarbons and a vitrinite reflectance of between about 0.5% and 1.1%; and a shale of high maturity would have very little kerogen, relatively little liquid hydrocarbons, a large quantity of gaseous hydrocarbons, and a vitrinite reflectance of greater than about 1.1%.

In nature, when oil shales mature and the kerogen converts to usable hydrocarbons, the pore pressures throughout the shale generally increase, and the usable hydrocarbons can generate enough pressure to create numerous fractures within the shale matrix material, allowing a portion the hydrocarbons to migrate to places of lower pressure. Other natural sources for fracturing include tectonic fractures and structural variation fracturing. In some circumstances, the network of fractures allows the hydrocarbons to migrate to a large common area of good porosity that may serve as an easily produced oil reservoir. Back at the original oil shale, however, once the pressure has been relieved by the portion of escaping hydrocarbons, the network of fractures will close, trapping the remaining hydrocarbons in the oil shale.

In less mature oil shales, the pressure may not yet have increased enough to create a network of fractures. In these cases, if one wants to gain access to the kerogen to generate hydrocarbons, he must artificially create fractures in the oil shale by applying external pressure—that is, the fracturing force must be applied external to the oil shale to be produced (such as by fluid fracturing or explosion). Even with relatively mature oil shales, technology has generally fractured the rock from the outside-in. Once the formation is fractured, technology is applied to produce any existing usable hydrocarbons through the induced fractures and/or to convert the kerogen to hydrocarbons at a rate much faster than would happen naturally.

Such conversion of kerogen is called pyrolysis and/or retorting. In one known method, kerogen-containing shale can be mined, crushed, and heated to high temperatures to convert the kerogen to liquid hydrocarbons. In other methods, kerogen is converted to hydrocarbons in situ (in place) by heat from combustion, electric or other heaters, and other heating methods and the resulting hydrocarbons are extracted.

As discussed, if the formation is not porous enough to allow the hydrocarbons to travel to a producing well, the shale is fractured via hydro-fracturing techniques or explosives to produce relatively large fissures which serve as conduits to carry hydrocarbons. Once the shale is fractured, it may also be heated in situ to release gases and oils through the large fissures.

It is also known in the art to perform in situ combustion to enhance recovery of oil and gas from a formation. Such methods may introduce an oxidant such as air or other oxygen-containing fluid into the formation, which then reacts exothermically with constituents of the hydrocarbon and/or rock system.

The exothermic reaction in the formation generates heat and other by-products. In conventional in situ combustion, the heat liberated is transferred to the hydrocarbon in the formation causing vaporization and mobilization of a lighter portion of the hydrocarbons which, when mixed with the remaining hydrocarbons results in a lowering of the hydrocarbon viscosity. This in turn increases the mobility of the hydrocarbons and facilitates its movement toward a production well via permeable routes or outside-in fractures. Additionally, as combustion occurs within the formation, the gases produced tend to increase the pressure in a region of the formation near the combustion front. The resulting differential pressure in the formation assists in moving remaining hydrocarbon toward a region of lower pressure, such as a production well.

An example can be found in U.S. Pat. No. 4,042,027, titled "Recovery of petroleum from viscous asphaltic petroleum containing formations including tar sand deposits," which teaches use of in situ combustion to accomplish thermal cracking and in situ hydrogenation to reduce the viscosity of the reservoir fluid and so to produce hydrocarbons in tar sands.

However, the prior applications of in situ combustion have relied on combustion to reduce viscosity of the reservoir hydrocarbons, such as by hydrocarbon distillation and subsequent dilution in a frontal advance displacement through a permeable matrix. Such prior applications of in situ combustion generally involve relatively permeable reservoirs such as tar sands, and do not involve less permeable reservoirs, such as shale. If the matrix is not naturally permeable, the prior applications will rely on induced fracturing to create permeability. Further, such methods do not rely on heat conduction and/or convection through the shale to create fluid expansion and subsequent mobility/matrix permeability improvement. Moreover, prior methods of in situ combustion have led to a production of primarily gaseous hydrocarbons, leaving valuable liquid hydrocarbons in the formation.

What is needed is a method for heat conduction and/or convection through low-permeable formations, such as shale, to create fluid expansion and subsequent mobility/matrix permeability improvement. What is needed is a method for producing hydrocarbons in less permeable reservoirs without relying primarily on artificially induced fracturing to create permeability. What is needed is a method for producing hydrocarbons that beneficially rejuvenates, from within the internal matrix porosity, an existing matrix of fractures to produce hydrocarbons, especially liquid hydrocarbons.

BRIEF SUMMARY OF THE INVENTION

In one embodiment of the present invention, a method for stimulating a hydrocarbon containing formation, comprises introducing a heat source in the formation, heating a portion of liquid hydrocarbons in the formation to expand their volume, thereby rejuvenating fractures, in some cases naturally occurring fractures, in the formation, passing at least some of the heated liquid hydrocarbons through the rejuvenated fractures, and producing at least a portion of the liquid hydrocarbons that passed through the rejuvenated fractures. Other fluids may be heated such as water and gaseous hydrocarbons. Eventually, the mobilized fluids can be produced via a production wellbore.

In some embodiments, the formation comprises shale, and in some cases the shale has a vitrinite reflectance of between about 0.5% and about 1.1%, while in others the shale has a vitrinite reflectance of between about 0.6% and about 1.0%, and in other cases the shale has a vitrinite reflectance of between about 0.7% and about 0.9%.

The heat source can comprise a heater and/or a reactant that will react in situ exothermically, and in some cases can comprise an oxygen containing fluid, such as air or pure oxygen. An oxygen containing fluid can be delivered from the surface at a pressure of at least about 4,000 psi and a temperature of at least about 120 degrees Fahrenheit, and can be introduced into an access wellbore and auto-igniting the oxygen containing fluid with in situ hydrocarbons. In additional, fluids that are not in-situ can be utilized along with the oxygen containing fluid to lower the combustion initiation temperature to match that of the reservoir conditions. The process can be structured such that liquid hydrocarbons move at a pressure above the bubble point pressure of the liquid hydrocarbons.

In some embodiments, liquid hydrocarbons are desorbed from in situ kerogen, and in other cases, the process comprises pyrolysis of in situ kerogen.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
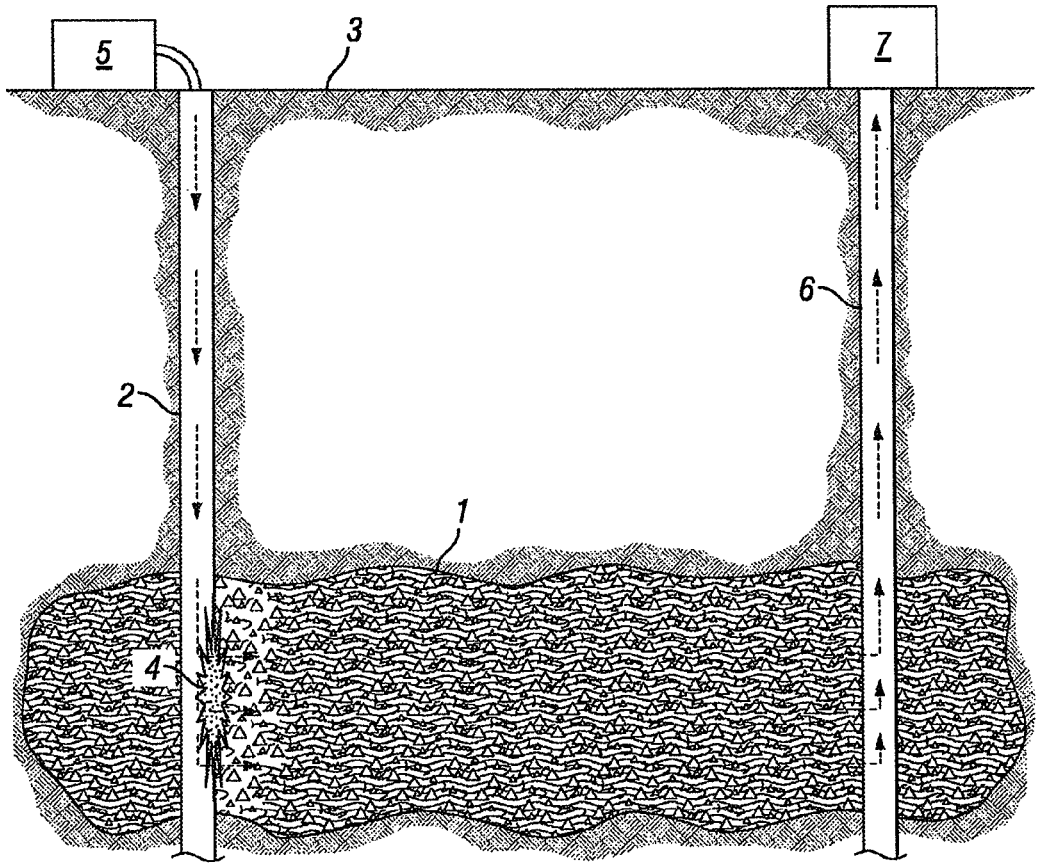
FIG. 1 is a profile downhole diagram representing an aspect of one embodiment of the present invention.

In one embodiment, the present invention is used in medium maturity oil shales, and thus this specification will primarily refer to such oil shales. One skilled in the art will realize that the methods and processes described herein are also applicable to a range of oil shales and to formations other than shales.

Certain relatively mature oil shales have a vast network of naturally created fractures created when fluid pressure built up to a fracturing point, allowing a portion of the fluids to migrate through the formation. The natural fractures are numerous and intricate, with many of the fractures being very small. It is believed that such naturally-occurring fractures are more highly branched and networked than those caused by artificial means. In such oil shale, after the fractures naturally formed and a portion of the fluids migrated out, the pressure in the shale lessened, causing the fractures to close and rendering the shale impermeable or less permeable.

Similarly, the same relatively mature oil shales that have extensive natural fracturing will generally have a relatively greater amount of producible liquid and/or gaseous hydrocarbons within the shale. While the methods disclosed herein will work with a variety of formations, in some embodiments they will be used in shales having a vitrinite reflectance of between about 0.5% and 1.1%, in some embodiments between about 0.6% and 1.0%, and in some embodiments between about 0.7% and 0.9%. In some embodiments, the invention will be utilized on the Barnett Shale in Texas, which has producible amounts of liquid and gaseous hydrocarbons, and in places has a vitrinite reflectance of about 0.8%. Of course, vitrinite reflectance is only one of several metrics by which to evaluate formations, and other metrics may be used to indicate applicable reservoirs.

The low permeability of many oil shales makes it difficult to produce useful hydrocarbons because they are relatively immobile. It can be especially difficult to produce liquid hydrocarbons (such as crude oil), which are viscous. One reason is that traditional fracturing using external fluids (i.e., induced fracturing) results in the creation of an only moderately complex fracture network, which creates a rapid pressure drop at the fracture face during production, which is thought to drop the liquid phase below the bubble point during the early stages of recovery. Thus, gas may be produced, but liquids become less mobile and cannot be produced. While not required, in some embodiments the present invention allows liquid recovery in which the pressure in the formation is generally maintained above the bubble point, preventing the formation and/or enhancement of free gas saturation in the matrix.

In many cases, it is desirable to minimize the pressure drop. To minimize the pressure drop and still achieve sufficient pressure differential to adequately recover the liquid hydrocarbon, it is desired to increase the surface area of the fracture system and increase internal pressure of the pores within the matrix. Increasing the surface area as much as possible will distribute the pressure drop throughout the reservoir utilizing the complex fracture network. This can be difficult because large volumes of matrix exist between propped fracture planes and effectively stimulated zones where liquid hydrocarbons cannot escape. Increasing the temperature of the matrix material will result in a fluid expansion and subsequent increase in internal pore pressure. Increasing the internal pressure of the pores within the matrix allows the liquid hydrocarbons to move through the pores and into the fractures, in many instances at pressures above the bubble point.

Because relatively mature shale contains significant amounts of liquid hydrocarbon (and liquids are relatively incompressible), liquid expansion from increased temperature represents a significant force. For example, the applicant estimates that in areas of the Barnett shale having vitrinite reflectance of about 0.8, an increase of only 10° F. will cause liquid volume expansion of 0.7%, which equates to about 250,000 barrels of oil per 640 acre section. Because the shale has an existing (albeit closed) fracture network, and because it is easier to rejuvenate (i.e., reopen) closed fractures than it is to create new fractures, the liquid volume expansion will rejuvenate the fractures, allowing liquid flow through the matrix. In many cases, the liquid will flow above the bubble point. Thus, compared to conventional processes, the embodiments of the present process require a relatively small amount of initial energy to begin hydrocarbon production and may lead to improved liquid production.

The present invention can apply in situ heat through a variety of heating methods, including injection of one or more combustible fluids, injection of one or more heated fluids, placement of electric, nuclear, or other heaters, and other methods, and may include combinations of the foregoing. In one embodiment, an oxygen-containing fluid (such as air, pure oxygen, etc.) is injected downhole simultaneously with linseed oil to generate an in situ exothermic reaction.

In some embodiments, injection of an oxygen-containing gas will be used with shales containing a hydrocarbon composition adequate for oxygen consumption or combustion, creating an exothermic reaction with heat as a major by-product. In some embodiments, reservoirs containing gasolines (e.g., C8-C16) and diesel (e.g., C16-C30) will be used, as some of those hydrocarbons may auto-ignite in the presence of oxygen under well conditions to generate the heat required to begin the process. Of course, an external ignition source can be supplied where desired.

Once heat is applied, in some cases the expanding liquid described above will enter and rejuvenate the complex fracture system that exists as a part of the formation's deposition and thermal maturity history. In addition, in some cases the heat will cause gases to expand, further rejuvenating the fractures. Once the fracture system has been rejuvenated, the reservoir fluids will be able to move through the reservoir to be produced by producer wells.

In some embodiments, as heat is continually applied, several processes may occur to further rejuvenate fractures and/or to lead to hydrocarbon production. These can include some or all of the following: thermal expansion of oil; thermal expansion of water or other liquids; gaseous expansion, release of clay-bound (and/or other material) water due to water vaporization; generation of steam; oil and water expansion due to reaction-product gas solubilization; oil and other liquid desorption and release from matrix kerogen (which can contain adsorbed hydrocarbons and other liquids); and liquid oil conversion from kerogen by pyrolysis.

In various embodiments, the process will perpetuate throughout the shale reservoir by one or more of the following mechanisms: thermal conduction of the heat (reaction by-product) through the rock matrix and formation; heat conduction and/or convection from migrating heated hydrocarbon and/or other fluids through the rejuvenated (and, in some cases, new) fracture system; heat conduction and/or convection from migrating steam (generated, e.g., from the existence of water held within clay (or other material) and water held in the pore space within the matrix); and combustion front advancement as combustible products are depleted with continued oxygen injection.

In some embodiments, as the process perpetuates throughout the formation, compositional changes occur in the treated formation that lead to further hydrocarbon recovery. Such changes can include the above discussed clay-bound (or other material) water vaporization, which renders the remaining clay (or other material) more porous from the absence of water and increases permeability due to matrix shrinkage, and kerogen pyrolysis, which results in fluid saturation modifications and permeability increase due to rock volume shrinkage. This increase in permeability can result in increased shale fluid mobility, and can allow the expanding fluids to effectively enter and maintain the fracture system in a rejuvenated state.

Additional formation properties may be beneficial in some embodiments. For example, biogenic or other silica within the matrix can enhance the rock hardness, making it more brittle and easier to fracture naturally (and through human intervention) in a very complex manner. In addition, silica and other materials can enhance the matrix porosity, increasing the fluid storage capacity of the formation. Carbonate-rich sequences inter-bedded within the formation can allow for an increase in the brittleness of the matrix, allowing for more fracturing, and can also provide increased porosity for increased fluid storage capacity. A relatively uniform present-time stress field can allow for complex fracture systems, which may lead to better production when rejuvenated. Further, a reservoir pressure at or near the bubble-point pressure can result in drawdown conditions that create lost or trapped oil not capable of being produced by conventional means.

EXAMPLES OF EMBODIMENTS OF THE PRESENT INVENTION

In one embodiment, an oxygen-containing fluid is injected into a reservoir with low permeability to combust some of the reservoir hydrocarbons to generate heat, which expands the volume of the liquid hydrocarbons and/or other fluids, causing existing fractures to rejuvenate (and possibly generating additional fractures) to allow enhanced hydrocarbon production.

FIG. 1 is a diagram representing one embodiment of the present invention utilizing vertical wells within oil shale. In accordance with the embodiment of FIG. 1, formation 1 contains usable hydrocarbons, and may be oil shale or another formation. In one embodiment, formation 1 is oil shale having a vitrinite reflectance of about 0.8%. In embodiments involving shale, the shale can be thermogenic or biogenic (or both) in nature and can be at various stages of thermal maturity.

An access wellbore 2 runs from the earth's surface 3 to formation 1 and can be used to deliver a heat source 4 into wellbore 2 at formation 1. Heat source 4 may be a variety of heat sources, including one or more combustible fluids, one or more heated fluids or solids, electric, nuclear, or other heaters, and other heat sources, and may include combinations of the foregoing. Heat source 4 may provide heat continuously or intermittently. In one embodiment, heat source is pressurized air delivered from surface 3 at about 5,000 psi and about 130° F. Other temperatures and pressures can of course be used. Surface equipment 5 delivers heat source 4 and other desired equipment or substances, if any, into wellbore 2.

Production wellbore 6 runs from formation 1 to the earth's surface 3 and can be used to produce fluids from formation 1. Surface production equipment 7 can be included to process the produced fluids. In one embodiment, heat source 4 creates an exothermic reaction with some hydrocarbons in formation 1, which thermally expands formation fluids and rejuvenates existing formation fractures as described previously. In addition, in some embodiments new fractures are created. Mobilized fluids, including hydrocarbons, thus move through formation 1 via the fracture system and propagate the rejuvenation as also described previously. Some of the mobilized fluids reach production wellbore 6 and are produced.

While FIG. 1 shows only one access wellbore and production wellbore, a plurality of either or both may be used. In addition, wellbores may be placed in any manner known in the art, and the arrangement will depend on the characteristics of the formation at the point of interest.

Figure 2:
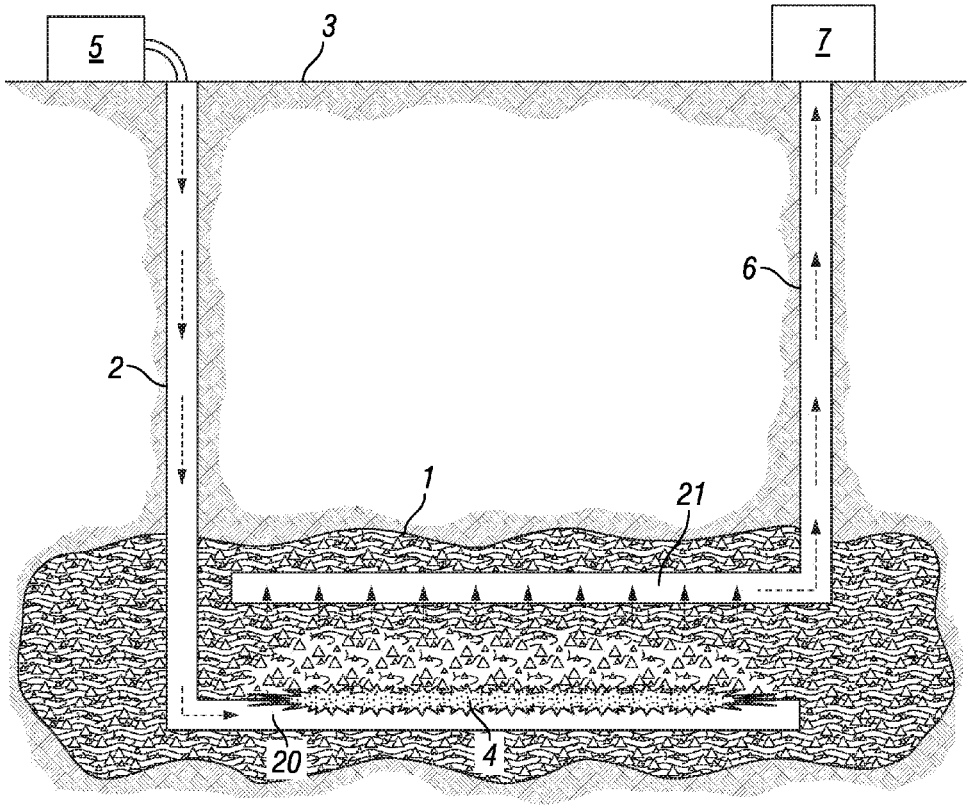
FIG. 2 is a profile downhole diagram representing an aspect of one embodiment of the present invention.

FIG. 2 is a diagram representing one embodiment of the present invention utilizing horizontal wells within the shale. Similar items are numbered the same in FIG. 2 as the corresponding item in FIG. 1. Thus, the embodiment of FIG. 2 includes a horizontal access wellbore 20 for delivering heat source 4 and a horizontal production wellbore 21 for producing hydrocarbons. In some embodiments, only one of access wellbore 20 or horizontal production wellbore 21 may be included if desired, with the other remaining only vertical. Similarly, wellbores of other slopes may be used in certain embodiments. As with FIG. 1, a plurality of any of the wellbores may be included, and branched wellbores are within the scope of the invention. In any of the various wellbore embodiments, the fracture rejuvenation and propagation occurs generally as described previously.

Figure 3:
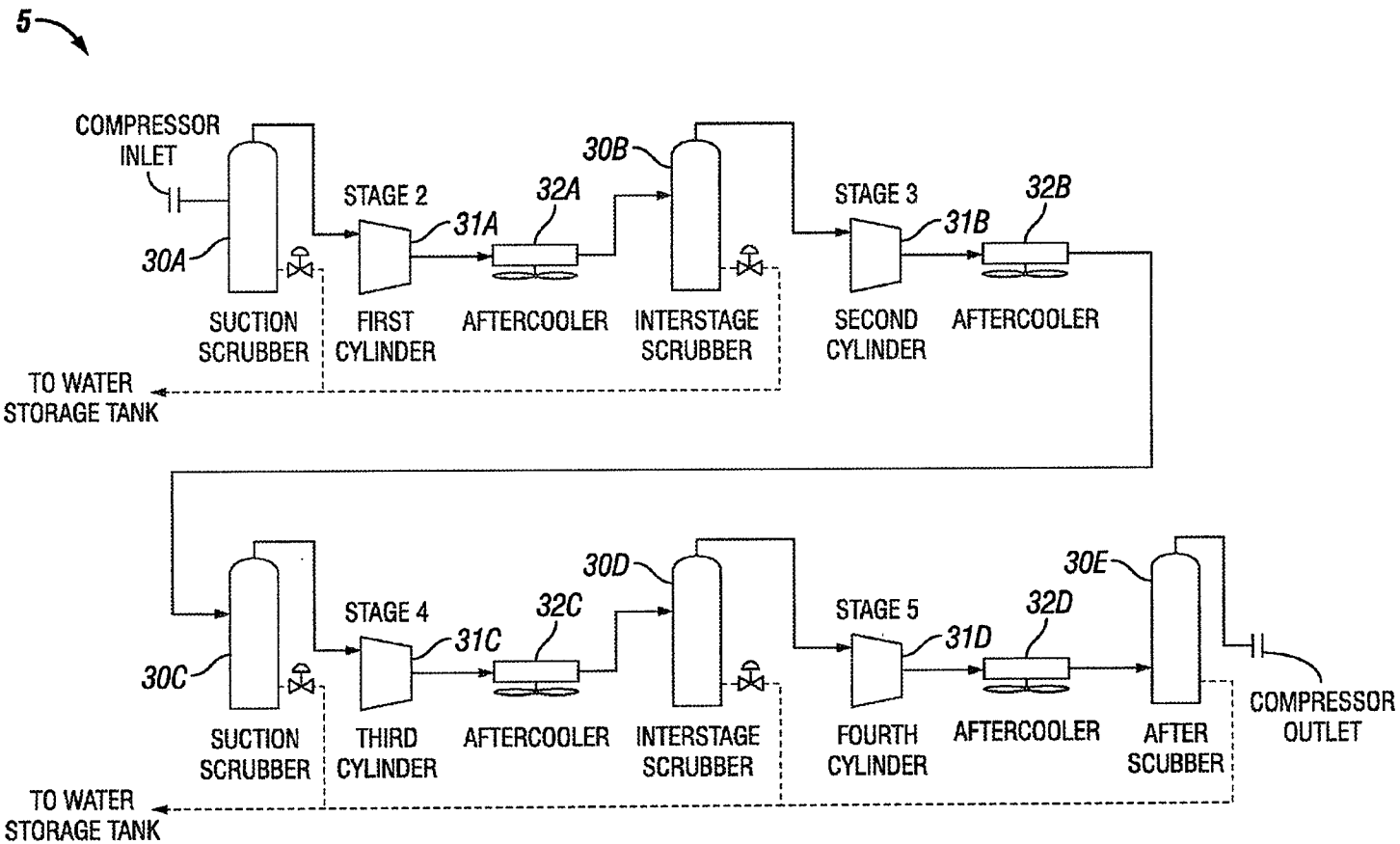
FIG. 3 is a schematic representing a pressurization unit for pressurizing a fluid to be injected in accordance with one embodiment of the present invention.

FIG. 3 shows a pressurization unit for pressurizing a fluid to be injected in accordance with one embodiment of the present invention. In the embodiment shown, surface equipment 5 includes stages of compressors, scrubbers, and coolers used to compress air to about 5,000 psi at a temperature of about 130° F. Equipment includes successive stage scrubbers 30A, 30B, 30C, 30D, and 30E, compressors 31A, 31B, 31C, and 31D, and coolers 32A, 32B, 32C, and 32D, arranged in a manner known in the art. Other methods of delivering compressed air are also within the scope of the invention.

Figure 4A:
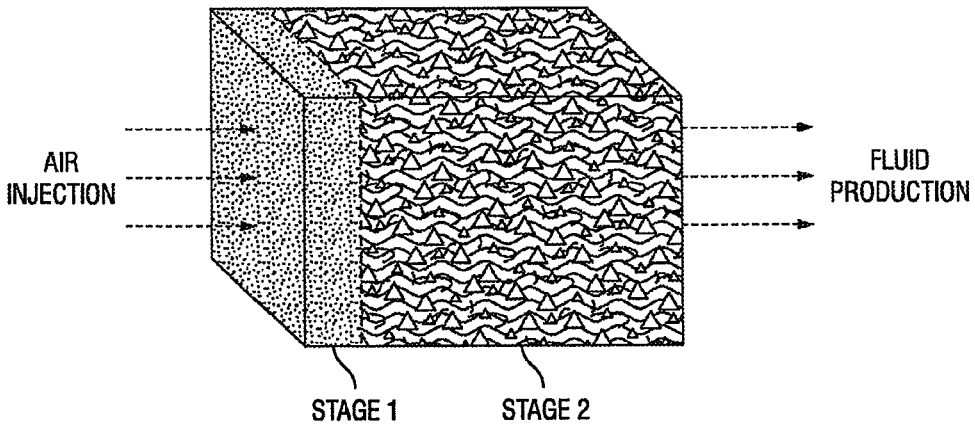
FIG. 4A, 4B are diagrams representing combustion propagation according to an aspect of one embodiment of the present invention.
Figure 4B:
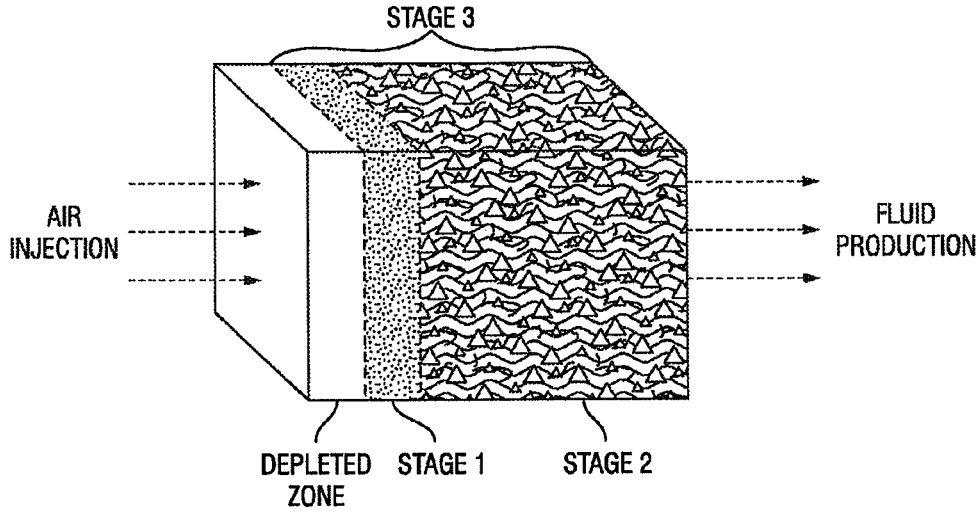
Figure 5:
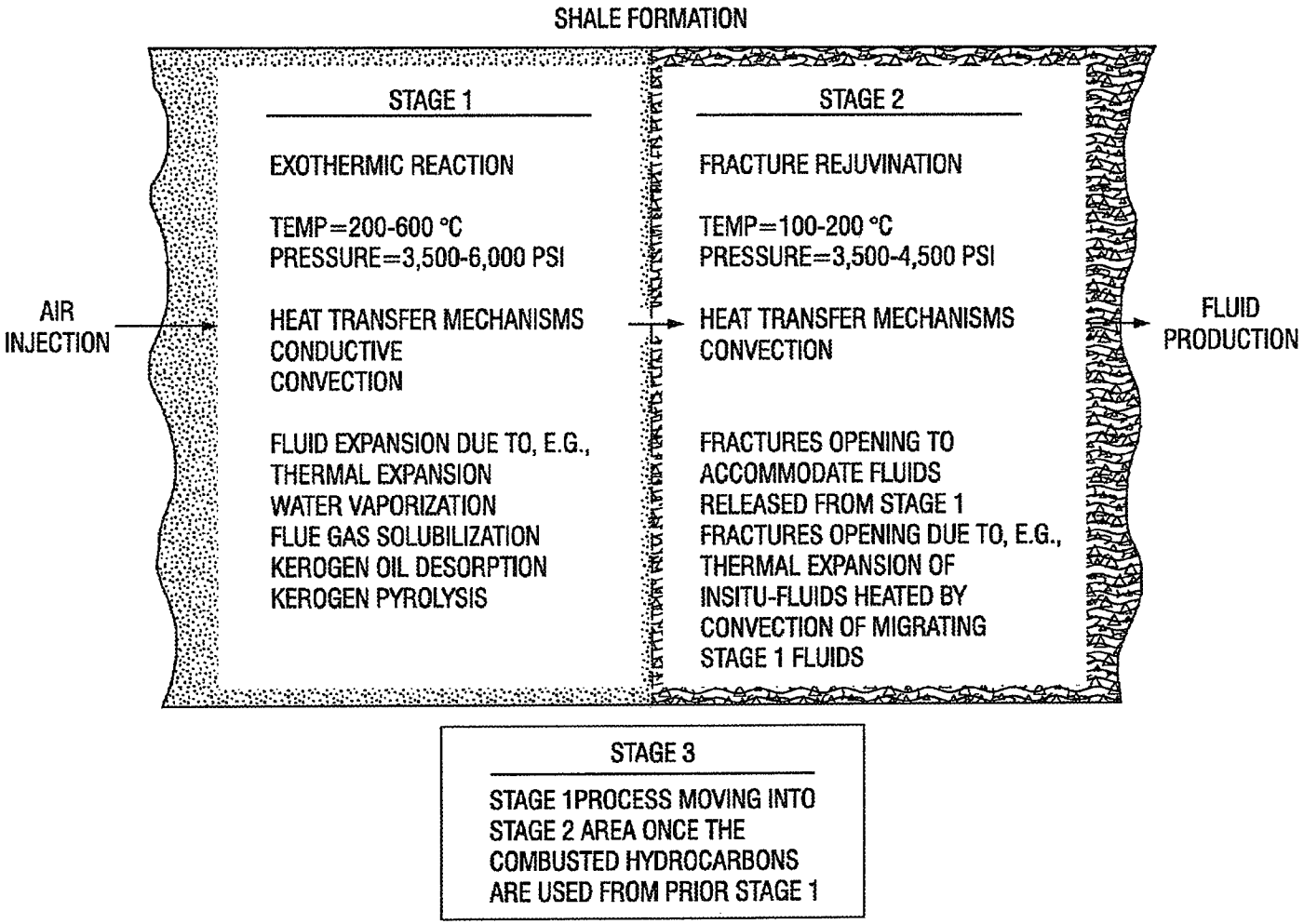
FIG. 5 is a flowchart representing combustion propagation according to an aspect of one embodiment of the present invention.

Referring now to FIGS. 4A, 4B and 5, FIGS. 4A and 4B is a non-limiting example demonstrating simplistically how combustion propagation may occur in one embodiment of the present invention. Similarly, FIG. 5 is a non-limiting flowchart representing simplistically how combustion propagation may occur in one embodiment of the present invention. Referring to FIGS. 4A, 4B and 5, In what has been termed "stage 1" for convenience, air is injected simultaneously with linseed oil into the formation from a wellbore. Oxygen in the air will exothermically react with the injected linseed oil and subsequently at the first contact with some of the hydrocarbons in the formation. This reaction or combination of reactions may, for example, occur at between about 200° C. and about 600° C. and a pressure of between about 3,500 psi and about 6,000 psi. Other temperatures and pressures may be present in some embodiments. The heat generated from the exothermic reaction is then transmitted primarily through conduction and convection creating a thermal expansion of all other fluids within the shale system.

In what has been termed "stage 2" for convenience, fracture rejuvenation and propagation of reaction occurs: The thermal expansion of fluids (described in stage 1) causes existing fractures to open to relieve excess pressure caused by the expansion. The opening of this fracture system allows the otherwise immobile fluids to migrate away from the point of combustion in the direction of lower pressure, specifically including a depletion point caused by an actively producing well. In addition to mobilized fluids, by-products of the combustion will also mix with the reservoir fluids and also aid in the fluid expansion, fracture propagation, and subsequent fluid migration. In this embodiment, heat is transferred primarily through convection at this stage. These processes may for example occur at between about 100° C. and about 200° C. and a pressure of between about 3,500 psi and about 4,500 psi. Other temperatures and pressures may be present in some embodiments.

In what has been termed "stage 3" for convenience and is shown in the bottom box of FIG. 5, the process distributes throughout the matrix: As the air continues to be injected, oxygen will pass unconsumed through the portion of the shale where certain hydrocarbons have been depleted by combustion or displaced as described in stage 2. Once oxygen contacts portions of the shale where hydrocarbon displacement is incomplete, the oxygen will then be consumed in the same reaction described in stage 1 above, thus initiating the process from that point again towards areas of lower pressure. This process may or may not be limited to the portions of the reservoir that are at elevated temperature due to the combustion process. This process can repeat until all the combustible hydrocarbons have been consumed or the displaceable hydrocarbons have been displaced in the volume of shale to be contacted and influenced by the in situ fluid reservoir stimulation process.

Of course, FIGS. 4A, 4B and 5 are simplistic representations, and in reality the propagation will generally occur in three dimensions and may not occur in compartmentalized sequences as shown.

Thus, in some embodiments of the invention, injection of an oxygen-containing gas, either with or without the addition of linseed oil or any other combustion additive, generates an exothermic reaction, and the by-products of and/or responses to the exothermic reaction can include one or more of the following: heat, liquid expansion, gaseous expansion, hydrocarbon vaporization, water vaporization, fluid desorption, and kerogen pyrolysis. In some embodiments, heated liquids and/or gases will expand, creating an increase in the matrix pore pressure; the increased pressure can rejuvenate existing fractures within the shale (and may also create new fractures); the heated fluids will escape from the matrix through the rejuvenated (and potentially other) fractures, carrying heat through convection as they travel from the heat source towards the producing well; fluid conveyed heat convection will further cause fluid expansion and hydrocarbon and/or water vaporization as fluids travel towards the producing well, causing further expansion and fracture rejuvenation (and possibly generation); and material-bound water vaporization can result in matrix volume shrinkage and potential subsequent porosity and/or permeability increase. In some additional embodiments, kerogen pyrolysis will result in matrix shrinkage, fluid saturation modification, porosity increase, and/or permeability increase.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for stimulating a hydrocarbon containing formation, comprising the steps of:

selecting a shale formation under natural pressure of at least about 3500 psi;

introducing a heat source into said formation;

heating a portion of liquid hydrocarbons in the formation to expand the volume of the hydrocarbons, thereby rejuvenating in the formation fractures caused by increased pore pressure due to natural liquid hydrocarbon generation;

passing at least some of the heated liquid hydrocarbons through the rejuvenated fractures; and producing at least a portion of the liquid hydrocarbons that passed through the rejuvenated fractures.

2. The method of claim 1, further comprising heating a portion of gaseous hydrocarbons in the formation to expand the volume of the hydrocarbons, thereby assisting in rejuvenating the formation fractures.

3. The method of claim 1, further comprising providing at least one access wellbore and at least one production wellbore.

4. The method of claim 1, further comprising thermally expanding in situ water.

5. The method of claim 1, further comprising generating steam in situ.

6. The method of claim 1, further comprising expanding at least a portion of the liquid hydrocarbons via gas solubilization.

7. The method of claim 1, further comprising desorbing liquid hydrocarbons from in situ kerogen.

8. The method of claim 1, further comprising pyrolysis of in situ kerogen.

9. The method of claim 1, wherein the heat source is selected from a group consisting of:

an electric heater, a nuclear heater, a chemical heater, injection of an oxygen-containing fluid that auto-ignites with the in situ hydrocarbons, injection of a reactant that will react in situ exothermically, injection of one or more combustible fluids, injection of one or more heated fluids, and any combination thereof.

10. The method of claim 9, wherein the oxygen containing fluid is delivered from the surface at a temperature of at least about 120 degrees Fahrenheit.

11. The method of claim 1, wherein the shale has a vitrinite reflectance of between about 0.5% and about 1.1%.

12. The method of claim 1, wherein the shale has a vitrinite reflectance of between about 0.6% and about 1.0%.

13. The method of claim 1, wherein the shale has a vitrinite reflectance of between about 0.7% and about 0.9%.

14. The method of claim 1, wherein the heat source comprises an oxygen containing fluid that creates an in situ combustion reaction; and further comprising perpetuating throughout a portion of the formation the steps of heating a portion of liquid hydrocarbons and passing at least some of the heated liquid hydrocarbons through the rejuvenated fractures by mechanisms selected from the group consisting of:

thermal conduction of heat through the formation, heat conduction from the migrating heated hydrocarbons, heat convection from the migrating heated hydrocarbons, combustion front advancement as combustible hydrocarbons are depleted with continued oxygen containing gas injection, and any combination thereof.

15. A method for stimulating a hydrocarbon containing formation, comprising the steps of:

introducing a heat source into a shale formation with a naturally occurring hydrocarbon maturity of at least about 0.6% vitrinite reflectance;

heating a portion of liquid hydrocarbons in the formation to expand the volume of the hydrocarbons, thereby rejuvenating fractures in the formation;

passing at least some of the heated liquid hydrocarbons through the rejuvenated fractures; and producing at least a portion of the liquid hydrocarbons that passed through the rejuvenated fractures.

16. The method of claim 15, further comprising heating a portion of gaseous hydrocarbons in the formation to expand the volume of the hydrocarbons, thereby assisting in rejuvenating the formation fractures.

17. The method of claim 15, further comprising providing at least one access wellbore and at least one production wellbore.

18. The method of claim 15, further comprising thermally expanding in situ water.

19. The method of claim 15, further comprising generating steam in situ.

20. The method of claim 15, further comprising expanding at least a portion of the liquid hydrocarbons via gas solubilization.

21. The method of claim 15, further comprising desorbing liquid hydrocarbons from in situ kerogen.

22. The method of claim 15, further comprising pyrolysis of in situ kerogen.

23. The method of claim 15, wherein the heat source is selected from a group consisting of:

an electric heater, a nuclear heater, a chemical heater, injection of an oxygen-containing fluid that auto-ignites with the in situ hydrocarbons, injection of a reactant that will react in situ exothermically, injection of one or more combustible fluids, injection of one or more heated fluids, and any combination thereof.

24. The method of claim 23, wherein the oxygen containing fluid is delivered from the surface at a temperature of at least about 120 degrees Fahrenheit.

25. The method of claim 15, wherein the shale has a vitrinite reflectance of between about 0.6% and about 1.1%.

26. The method of claim 15, wherein the shale has a vitrinite reflectance of between about 0.6% and about 1.0%.

27. The method of claim 15, wherein the shale has a vitrinite reflectance of between about 0.7% and about 0.9%.

28. The method of claim 15, wherein the heat source comprises an oxygen containing fluid that creates an in situ combustion reaction; and further comprising perpetuating throughout a portion of the formation the steps of heating a portion of liquid hydrocarbons and passing at least some of the heated liquid hydrocarbons through the rejuvenated fractures by mechanisms selected from the group consisting of:

thermal conduction of heat through the formation, heat conduction from the migrating heated hydrocarbons, heat convection from the migrating heated hydrocarbons, combustion front advancement as combustible hydrocarbons are depleted with continued oxygen containing gas injection, and any combination thereof.

* * * * *